US008146573B2

(12) United States Patent
Oohashi et al.

(10) Patent No.: US 8,146,573 B2
(45) Date of Patent: Apr. 3, 2012

(54) EGR DEVICE FOR ENGINE

(75) Inventors: Hiroshi Oohashi, Osaka (JP); Hiroshi Masuda, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 197 days.

(21) Appl. No.: 12/521,818

(22) PCT Filed: Nov. 8, 2007

(86) PCT No.: PCT/JP2007/071713

§ 371 (c)(1),
(2), (4) Date: Jun. 30, 2009

(87) PCT Pub. No.: WO2008/096488

PCT Pub. Date: Aug. 14, 2008

(65) Prior Publication Data

US 2010/0031937 A1 Feb. 11, 2010

(30) Foreign Application Priority Data

Feb. 8, 2007 (JP) ..... 2007-029763

(51) Int. Cl.
*F02B 47/08* (2006.01)
*F02M 25/07* (2006.01)

(52) U.S. Cl. ..... 123/568.21; 123/568.22; 123/568.32; 123/568.31

(58) Field of Classification Search ..... 123/568.11, 123/568.16, 568.21, 568.22, 568.25, 568.26, 123/568.27, 568.32, 568.31
See application file for complete search history.

(56) References Cited

U.S. PATENT DOCUMENTS

| | | | | |
|---|---|---|---|---|
| 4,137,874 | A * | 2/1979 | Otsubo et al. | 123/676 |
| 4,176,635 | A * | 12/1979 | Nakamura et al. | 123/676 |
| 4,176,638 | A * | 12/1979 | Kitamura et al. | 477/111 |
| 4,181,110 | A * | 1/1980 | Kohama et al. | 123/676 |
| 4,230,079 | A * | 10/1980 | Kohama et al. | 123/676 |
| 4,398,525 | A * | 8/1983 | Ahrns et al. | 123/568.32 |
| 4,614,184 | A * | 9/1986 | Hansen | 123/339.28 |
| 5,203,311 | A * | 4/1993 | Hitomi et al. | 60/605.2 |
| 6,408,833 | B1 * | 6/2002 | Faletti | 123/568.17 |

(Continued)

FOREIGN PATENT DOCUMENTS

CN 1536215 10/2004

(Continued)

OTHER PUBLICATIONS

International Search Report for International Application No. PCT/JP2007/071713 dated Feb. 5, 2008, 2 pgs.

(Continued)

*Primary Examiner* — Thomas Moulis
(74) *Attorney, Agent, or Firm* — Sterne, Kessler, Goldstein & Fox P.L.L.C.

(57) ABSTRACT

It is intended to provide an EGR device for an engine in which a cooling structure such as an EGR cooler is not required and which reduces Nox contained in the exhaust gas in the whole operation areas, so as to correspond to recent exhaust gas regulation. An EGR device 30 for an engine comprises an EGR pipe 14 for continuously connecting an exhaust manifold 4 and an intake manifold 3 of an engine 1, an EGR valve 9 for controlling a passage area of the EGR pipe 14, an ECU 6 for controlling the EGR valve 9. The EGR device 30 further comprises a bypass passage 24 for bypassing the EGR valve 9 and a restrictor 25 is installed in the bypass passage 24.

6 Claims, 4 Drawing Sheets

U.S. PATENT DOCUMENTS

| | | | | |
|---|---|---|---|---|
| 6,470,864 | B2 * | 10/2002 | Kim et al. | 123/568.12 |
| 6,868,840 | B2 * | 3/2005 | Lewallen | 123/563 |
| 7,257,950 | B2 * | 8/2007 | Iwaszkiewicz | 60/605.2 |
| 2006/0042608 | A1 | 3/2006 | Buck et al. | |

FOREIGN PATENT DOCUMENTS

| | | | |
|---|---|---|---|
| JP | 57-139657 | U | 2/1981 |
| JP | 58-158154 | | 10/1983 |
| JP | 60-26263 | | 2/1985 |
| JP | 63-83454 | | 6/1988 |
| JP | 06-137221 | | 5/1994 |
| JP | 2001-159361 | | 6/2001 |
| JP | 2004-346918 | | 9/2004 |
| JP | 2005-344677 | | 12/2005 |

OTHER PUBLICATIONS

Chinese Office Action for corresponding CN Application No. 200780050876.5, Chinese Patent Office, mailed Mar. 9, 2011, 9 pages.

Korean Office Action for corresponding KR Application No. 10-2009-7013886, Korean Patent Office, mailed Apr. 12, 2011, 8 pages.

Japanese Office Action for corresponding JP Application No. 2007-029763, Japanese Patent Office, mailed May 17, 2011, 6 pages.

* cited by examiner (a)

(b)

(a)

(b)

EGR DEVICE FOR ENGINE

BACKGROUND OF THE INVENTION

1. Field of the Invention

The present invention relates to an EGR device for use in an engine, and more specifically relates to a constructing technique for bypassing an EGR control valve equipped with the EGR device.

2. Related Art

Conventionally, there is widely known an EGR (Exhaust Gas Recirculation) device, which refluxes a part of exhaust gas from an exhaust system to an intake system in an engine, for the purpose of reducing nitrogen dioxide ($No_x$) generation included in the exhaust gas. There is also well known a technique of the EGR device for the engine provided with an EGR valve for controlling a reflux volume of the EGR gas, in the EGR device.

Meanwhile, because when an engine load is increased, the temperature of the exhaust gas (the EGR gas) is generally increased, there is widely known an EGR device provided with an EGR cooler near the EGR valve, so as to reflux the high-temperature EGR gas in a high load area, and there is well-known a technique for avoiding a damage of the EGR cooler and for enhancing the safety of the EGR device, by bypassing the EGR cooler and preventing an abnormal pressure increase of the EGR cooler.

For example, JP 2004-346918 discloses a technique, which a bypass passage bypassing the EGR cooler is connected between an EGR pipe upstream of the EGR gas and an EGR pipe downstream of the EGR gas in the EGR cooler, or between an EGR pipe upstream of the EGR gas and the engine intake system in the EGR cooler, as well as which a changeover valve is mounted to a bifurcated portion between the bypass passage and the EGR pipe upstream of the EGR gas, and a manometer is attached to the upstream of the EGR gas in the changeover valve and a thermometer is attached to a refrigerant lead-out port of the EGR cooler, wherein the control means bypasses the EGR gas to the bypass passage by controlling the opening and closing of the changeover valve, when any one of the detection values by the manometer or the thermometer reaches the predefined setting value.

DISCLOSURE OF INVENTION

Problems to Be Solved By the Invention

Due to the construction disclosed in the above-mentioned patent literature, when the temperature of the EGR gas is increased due to an abnormal combustion of the engine or the like or when the back pressure to the EGR gas is increased by the clogging of the EGR cooler due to soot with long-term use, the EGR gas can be recirculated to the engine intake system by bypassing the EGR cooler, thereby being capable of preventing the damage of the EGR cooler and improving the safety of the EGR device.

However, since the EGR cooler that contributes significantly to the reduction in the $No_x$ of a diesel engine is a consumable supply, it needs to be maintained or replaced after a certain degree of duration of service, and EGR cooler requires additional coolant water introducing pipe or a cooled air introducing passage for the EGR cooler, leading to the increasing of cost. It is disadvantageous in that as the EGR gas does not go through the EGR cooler when the EGR cooler is clogged, the high-temperature EGR gas is introduced into the intake system and the combustion temperature is increased, thereby leading to the inconsiderable contribution to the reduction in the $No_x$.

In consideration of the above-described problems, it's an object of the present invention to provide an EGR device for an engine without a cooling structure such as an EGR cooler.

Further, it's an object of the present invention to provide an EGR device for an engine that reduces $NO_x$ included into an exhaust gas in the whole operation areas, so as to correspond to the recent exhaust gas regulation.

SUMMARY OF THE INVENTION

An EGR device for an engine of the present invention comprises an EGR passage for continuously connecting an exhaust passage and an intake passage of the engine, an EGR control valve for controlling a passage area of the EGR passage, and a control means for controlling the EGR control valve. The EGR device further comprises a bypass passage for bypassing the EGR control valve and a restrictor in the bypass passage.

In the EGR device for the engine, it is preferable that a detecting means for detecting an exhaust gas temperature of the engine is provided and the detecting means is connected to the control means, wherein the control means controls the EGR control valve corresponding to the exhaust gas temperature detected by the detecting means so as to change the passage area, and the control means controls the EGR control valve so that it is totally closed, when the exhaust gas temperature is a setting value preliminarily set up or higher.

In the EGR device for the engine, it is preferable that the restrictor is provided in the bypass passage and the restrictor is a fixed restrictor.

In the EGR device for the engine, it is preferable that the restrictor is provided in the bypass passage and a means for adjusting a throttling degree of the restrictor is provided with the restrictor.

In the EGR device for the engine, it is preferable that the bypass passage is provided in a mechanism making up the EGR control valve.

In the EGR device for the engine, it is preferable that a means for adjusting the throttling degree of the restrictor is installed on the restrictor provided in the mechanism making up the EGR control valve.

Due to the EGR device for the engine of the present invention, the EGR gas can be introduced in the whole operation areas of the engine by bypassing the EGR valve having lower thermal resistance. The amount of the EGR gas can be increased or the EGR valve can be minified. The EGR gas can be introduced without involving the EGR valve even in high-load areas where the exhaust gas becomes high temperature, by providing a restrictor which can secure the minimum EGR gas for reducing the $NO_x$ in the high-load areas, thereby extending a life span of an electromagnetic device provided with the EGR valve so as to extend the life span of the whole EGR valve.

The EGR device for the engine of the present invention can set up the maximum temperature of the EGR gas flowing through the EGR control valve. When the EGR control valve is totally enclosed, due to the lower thermal conductivity of the gas, the heat is hard to be transmitted to the EGR control valve. Accordingly, the thermal resistance of the EGR control valve need not be considered, thereby eliminating the need for the EGR cooler or a particular kind of heat resistance structure.

The EGR device can be installed to the conventional intake/exhaust system, by forming the bypass in the EGR passage (the pipe making up the EGR passage).

The EGR device for the engine can have the general versatility of the engine specifications (model, size or the like), by controlling the opening degree of the restrictor.

A particular kind of thermal resistant specification in the EGR cooler conventionally provided with the upstream of the EGR control valve or the EGR control valve itself becomes unnecessary, just by replacing the EGR control valve, even in the existing EGR device, by making up the bypass in the mechanism comprising the EGR control valve.

The EGR device for the engine can have the general versatility of the engine specifications (model, size or the like), by controlling the opening degree of the restrictor. The EGR device comprised of the EGR passage, the EGR control valve or the like can be unified as an EGR unit, by providing a means for controlling the throttling degree in the mechanism making up the EGR control valve.

BRIEF DESCRIPTION OF THE DRAWINGS

FIG. 4(*a*) is a planar sectional view of the EGR valve and FIG. 4(*b*) is cross sectional view of the EGR valve in FIG. 4(*a*) along the line A-A'.

1 engine
6 ECU (Electronic Control Unit)
9 EGR valve (EGR control valve)
23 exhaust temperature sensor (exhaust gas temperature detecting means)
24 bypass passage
25 restrictor
30 EGR device

DETAILED DESCRIPTION OF THE INVENTION

Figure 1:
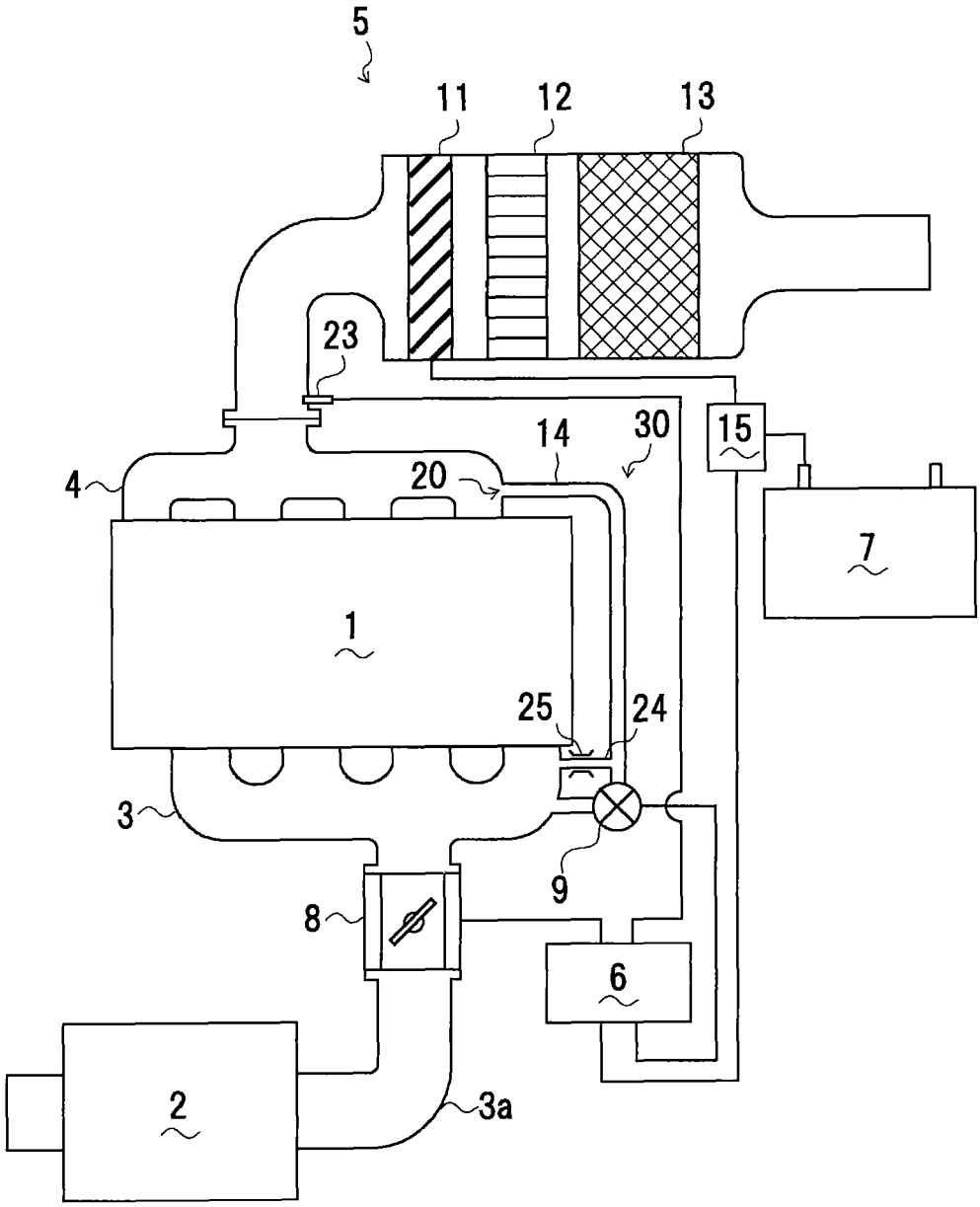
FIG. 1 is a pattern diagram of an intake/exhaust system of an engine according to an embodiment of the present invention.

Hereinafter, embodiments of an engine equipped with an EGR device for the engine according to the present invention will be described, with reference to the drawings First, an intake/exhaust system of the engine 1 according to the first embodiment of the present invention will be described, with reference to FIG. 1.

The air inhaled into the engine 1 is introduced from an air cleaner 2 as an air intake and is fed into an intake manifold 3 connected to the air cleaner 2 via an intake pipe 3*a*. The intake manifold 3 is connected to an intake port of a cylinder head in the engine 1, so that the air is inhaled into a cylinder.

An intake throttle 8 for controlling the inlet flow is provided in the intake pipe 3*a*. The intake throttle 8 is a butterfly valve that the opening degree thereof is changed by an actuator (not shown) such as a motor provided with the inside of the intake throttle 8. The actuator is connected to an after-mentioned ECU 6 as a control means, in which the opening/closing thereof is controlled based on a control signal from the ECU 6.

In this regard, the construction of the intake throttle 8 is not limited to the one in the present embodiment, and the construction in which the opening/closing operation thereof can be controlled by the electric signal from the ECU 6 may be applicable.

In the cylinder, the exhaust gas that has been arbitrarily mixed and combusted with a fuel supplied by a fuel injection device is fed into an exhaust manifold 4 via an exhaust port provided with the cylinder head as outlet from the cylinder. The exhaust manifold 4 is attached on the downstream thereof with an exhaust gas filter 5 for discharging the exhaust gas in the atmosphere and the exhaust gas filter 5 is connected on the downstream thereof to a silencer (not shown).

An exhaust air heater 11, an oxidation catalyst 12, a soot filter 13 are incorporated into the exhaust gas filter 5 in order from the upstream of the exhaust gas filter 5. The exhaust air heater 11 is connected via a heater relay 15 to a battery 7, and the heater relay 15 is connected to the after-mentioned ECU 6 so that the power on/off thereof is controlled by a control signal from the ECU 6. The exhaust air heater 11 has a facilitating effect on the actions of the oxidation catalyst 12 and the soot filter 13 disposed on the down stream thereof, by increasing the temperature of the exhaust gas.

An exhaust temperature sensor 23 as a detecting means for the exhaust gas temperature is provided near a connection between the exhaust gas filter 5 and the exhaust manifold 4. The exhaust temperature sensor 23 is connected to the after-mentioned ECU 6 and outputs a detection value to the ECU 6.

Next, an EGR device 30 provided with the engine 1 will be described.

The EGR device 30 is comprised of an EGR pipe 14, an EGR valve 9 and so on.

The exhaust manifold 4 is provided in place thereof with an EGR gas exhaust 20, and the EGR gas exhaust 20 is connected to one end of the EGR pipe 14. The EGR pipe 14 is connected at the other end thereof to the intake manifold 3. Thus, the EGR passage is formed so as to reflux a part of the exhaust gas as the EGR gas.

Figure 3:
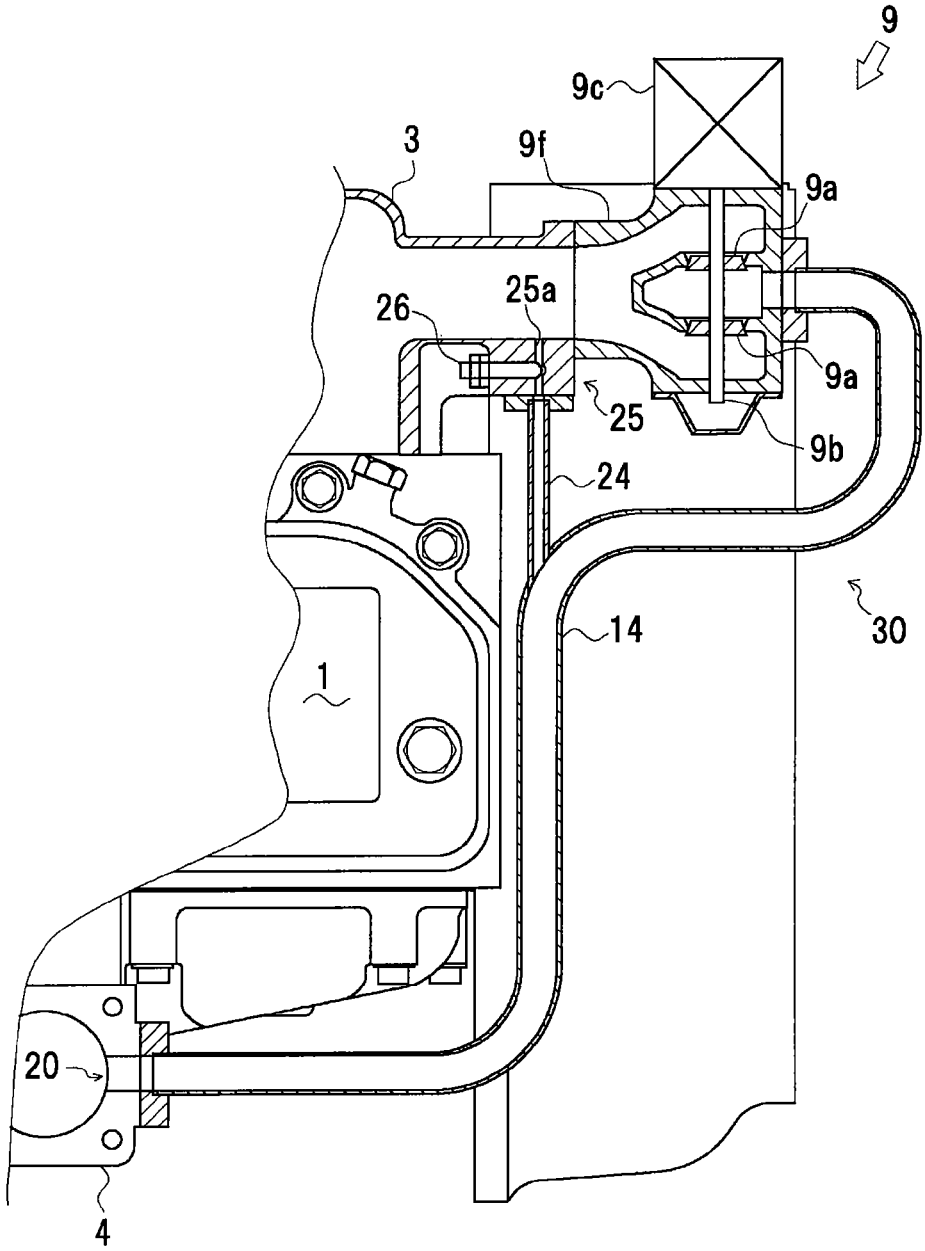
FIG. 3 is a partial cross sectional view in the planar view illustrating a construction of an EGR device of the engine according to the second embodiment of the present invention.

The EGR pipe 14 is attached at the midstream thereof to the EGR valve 9 for controlling a flow rate of the EGR gas. As shown in FIG. 3, the EGR valve 9 includes two control valves 9*a*, 9*a*, a rod 9*b* which penetrates the control valves 9*a*, 9*a* so as to be fixedly provided therewith in a valve casing 9*f*, an actuator 9*c* consisting of a motor or the like which is connected to one end of the rod 9*b* and is disposed on the outside of a valve casing 9*f* and so forth. The actuator 9*c* is connected to the after-mentioned ECU 6, and the actuator 9*c* is operated due to a control signal from the ECU 6 so as to reciprocate the rod 9*b*, so that the control valves 9*a*, 9*a* fixed and interlocked with the rod 9*b* are opened and closed.

Depending on the opening degree of the EGR valve 9 having the above-described construction, a passage area in the EGR pipe 14 is determined, and the reflux volume of the EGR gas flowing back into the EGR device 30 is determined.

In this regard, the construction of the EGR valve 9 is not limited to the one in the present embodiment, and the construction in which the opening/closing operation thereof can be controlled by an electric signal from the ECU 6 may be applicable.

The ECU (Electronic Control Unit) 6 as a control means for controlling the operation of the engine 1 is disposed in place near the engine 1. The ECU 6 includes a CPU, a ROM, a RAM, A/D converter, an input-output interface or the like (not shown).

The ECU 6 performs the opening/closing control for adjusting the opening degree of the intake throttle 8 by controlling the operation of the actuator provided with the intake throttle 8 and performs the opening/closing control for adjusting the opening degree of the EGR valve 9 by controlling the operation of the actuator 9*c* provided with the EGR valve 9, thereby adjusting the EGR rate of the engine 1.

Incidentally, the ECU 6 connects a rotation number sensor for detecting a rotation number of the engine 1, a rack actuator for adjusting the fuel injection volume, a starter for assisting the starting of the engine 1, another sensors and an actuator resemblance when they are needed, and the ECU 6 controls them so as to optimize the operation of the engine 1.

A solenoid device (such as the actuator) provided with the EGR valve 9 generally has a restricted thermal resistance and requires a EGR cooler or a particular heat resistance structure or the like so as to protect the EGR valve 9, thereby leading to the increase in the cost. Especially in the engine equipped with the EGR cooler, there are problems on the cost for adding the cooling pipe or the size thereof.

Consequently, in the present embodiment, a bypass passage 24, which is continuously connected to the intake manifold 3 from the upstream of the EGR valve 9 in the EGR pipe 14, i.e., which bypasses the EGR valve 9, is formed, in the conventional EGR device 30. A restrictor 25 is provided in the bypass passage 24, so that the EGR gas is easy to pass through the bypass passage 24, when the amount of the EGR gas passing through the EGR valve 9 is small due to the resistance (the opening degree) of the restrictor 25 (or the EGR valve 9 is totally closed). On the contrary, when the opening degree of the EGR valve 9 is large, the EGR gas is hard to pass through the bypass passage 24.

Specifically, the diameter of the restrictor 25 is determined so that the minimum EGR gas for the operation of the engine 1 in a high-load area where the exhaust gas temperature becomes higher can be secured through the bypass passage 24.

Figure 2:
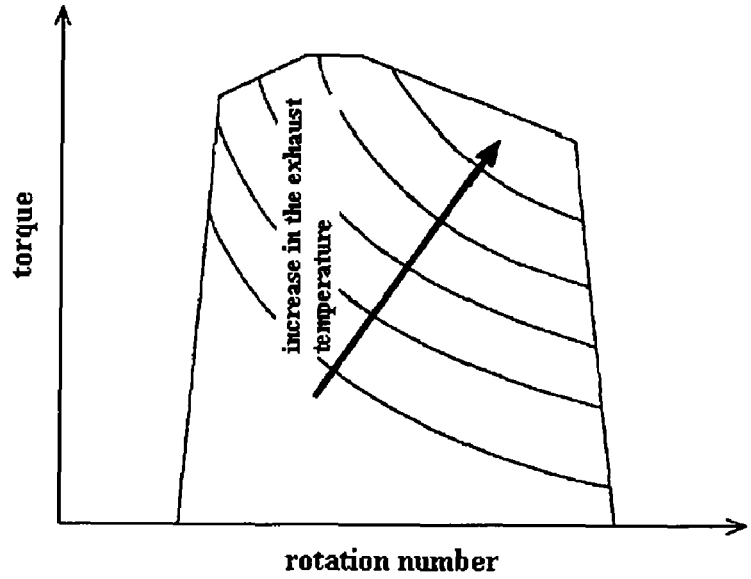
FIG. 2(*a*) is a diagram illustrating a relationship between an engine torque, a rotation number and an exhaust temperature, and FIG. 2(*b*) is a diagram illustrating a relationship between the engine torque, the rotation number and the opening degree of the EGR valve, when the longitudinal axis is the engine torque and the horizontal axis is the rotation number.
Figure 2:
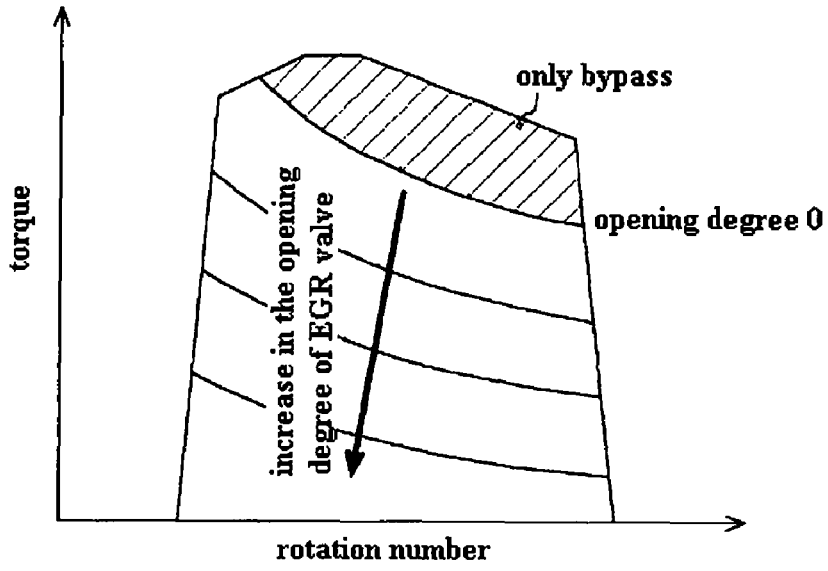

One example of the functional characteristic of the exhaust gas temperature and the opening/closing control according to the opening degree of the EGR valve 9 in the present embodiment corresponding to the functional characteristic will be described, using maps that the horizontal axis and the longitudinal axis are respectively the rotation number and the output torque of the engine 1 as illustrated in FIGS. 2(*a*) and (*b*).

A contour in FIG. 2(*a*) shows that of the exhaust temperature of the engine 1, it is apparent that the exhaust temperature is increased as the torque or the rotation number is higher, i.e., as the contour goes from the bottom left to the top right.

FIG. 2(*b*) is an example of controlling the EGR valve 9 so as to secure the EGR volume corresponding to the exhaust gas regulation, and the contour shows the opening degree of the EGR valve. The exhaust gas temperature detected by the exhaust temperature sensor 23, and the rotation number detected by the rotation number sensor of the engine 1, or the opening degree of the EGR valve 9 in accordance with the output torque of the engine 1 are determined, thereby controlling the EGR valve 9 so that the $NO_x$ generation or the like do not exceed the exhaust gas regulation value.

The above-mentioned maps in FIGS. 2(*a*) and (*b*) are preliminarily memorized in the ECU 6, and the ECU 6 receives an input of the exhaust gas temperature from the exhaust temperature sensor 23 and an input of the rotation number of the engine 1 from the rotation number sensor, so as to determine the contour corresponding to the exhaust temperature referring to the map shown in FIG. 2(*a*) and determine the opening degree of the EGR valve 9 corresponding to the rotation number on the contour referring to the map shown in FIG. 2(*b*).

Specifically, when the exhaust temperature is beyond the heat-resistant threshold temperature (which is preliminarily memorized in the ECU 6) of the solenoid device or the like making up the EGR valve 9, or when exhaust temperature is high to a certain degree and the rotation number is low, the EGR valve 9 is controlled so that it is totally closed so as to reflux the EGR gas from only the bypass passage 24. Meanwhile, when the exhaust temperature is the heat-resistant threshold temperature or low, the opening degree of the EGR valve 9 is adjusted so that the $No_x$ generation can be controlled when needed.

In the present embodiment, the opening degree of the EGR valve 9 is controlled based on two aspects of the exhaust gas temperature and the rotation number, so as to fully exert the performance of the engine 1 even during the low rotation number and the high output, but the opening degree of the EGR valve 9 can be controlled based on one aspect of the exhaust gas temperature, and it goes without saying that the opening degree can be also controlled based on the other aspect such as the performance matching of the engine.

As seen from the above, in the EGR device 30 for the engine equipped with the EGR pipe 14 which continuously connects the exhaust manifold 4 and the intake manifold 3, the EGR valve 9 which controls the passage area of the EGR pipe 14, the ECU 6 which controls the EGR valve 9, the bypass passage 24 bypassing the EGR valve 9 is provided and the bypass passage 24 is provided with the restrictor 25, so that the EGR gas can be introduced in the whole operation areas of the engine 1 by bypassing the EGR valve 9 having the low thermal resistance. Also, the EGR gas volume can be increased or the EGR valve 9 can be minified. The EGR gas can be introduced without the EGR valve 9 even in the high-load area where the temperature of the exhaust gas is increased, by providing the restrictor 25 which can secure the minimum EGR gas for reducing the $No_x$ in the high-load area, thereby extending the life span of the electromagnetically-driven device provided with the EGR valve 9, so as to extend the life span of the whole EGR valve 9.

The exhaust temperature sensor 23 for detecting the exhaust gas temperature of the engine 1 is provided, and the exhaust temperature sensor 23 is connected to the ECU 6, which controls the EGR valve 9 according to the exhaust gas temperature detected by the exhaust temperature sensor 23 and which changes the opening degree thereof so as to change the passage area, as well as when the exhaust gas temperature is the preset temperature preliminarily set up or higher, the EGR valve 9 is controlled so that it is totally closed so as to reflux the EGR gas from only the bypass passage 24, so that the temperature of the EGR gas having lower thermal conductivity is hard to be transmitted to the EGR valve 9. In other words, the thermal resistance of the EGR valve 9 needs not to be considered, by setting up the maximum temperature of the EGR gas flowing through the EGR valve 9, thereby eliminating the need for the EGR cooler or a particular kind of heat resistance structure.

Because the restrictor 25 is provided in the bypass passage 24 and is a fixed restrictor, the EGR device 30 can be installed to the conventional intake/exhaust system, by making up the bypass and the restrictor in the EGR passage (the pipe).

An EGR device according to the second embodiment of the present invention will be described, with reference to FIG. 3. In this regard, the description on the whole construction of the engine 1 in the present embodiment or the like will be omitted, since it is substantially the same as the construction in the first embodiment.

In the present embodiment, the EGR valve 9 is continuously attached to the intake manifold 3, and the outlet of the EGR gas in the EGR valve 9 is provided so that it is directly engaged on the intake manifold 3. The bypass passage 24 is provided so that it is continuously connected from the midstream of the EGR pipe 14 to the intake manifold 3, and the bypass passage 24 is provided on the side of the intake manifold 3 with the restrictor 25. The bypass passage 24 is connected to a restrictor passage 25*a* provided with the side wall of the intake manifold 3. The inner diameter of the restrictor passage 25*a* is much smaller than that of the bypass passage 24, and is determined so that the minimum EGR gas can be secured for the operation of the engine 1 in the high-load area having higher exhaust gas temperature The restrictor passage 25*a* is disposed at the midstream thereof with an adjuster 26 comprising of a bolt or the like, as a means for adjusting the throttling volume. The degree of fastening the adjuster 26 is adjusted, whereby the passage area of the restrictor passage 25*a* can be adjusted. In other words, the reflux volume of the EGR gas can be adjusted when the EGR valve 9 is totally closed.

As seen from the above, the restrictor passage 25*a* is provided in the bypass passage 24, and the adjuster 26 is provided with the restrictor passage 25*a*, thereby having the general versatility of the engine specifications (model, size or the like), by controlling the opening degree of the restrictor passage 25*a*.

Figure 4:
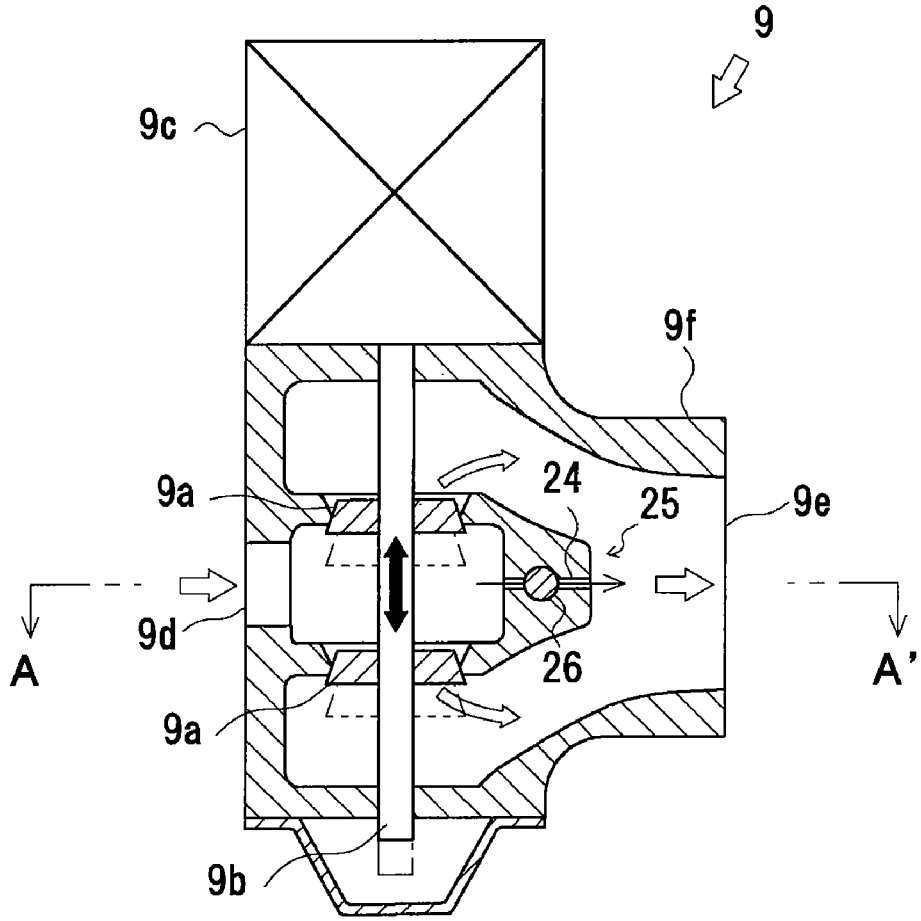
FIG. 4 is an enlarged view of an EGR valve according to the third embodiment of the present invention.
Figure 4:
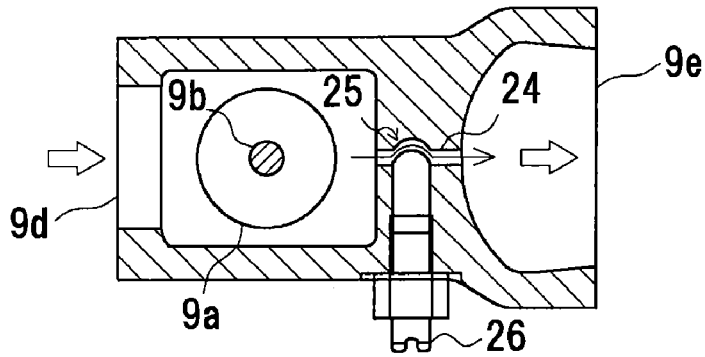

An EGR valve 9 according to the third embodiment of the present invention will be described, with reference to FIG. 4.

In this regard, the description on the whole construction of the engine 1 in the present embodiment or the like will be omitted, since it is substantially the same as the construction in the first embodiment.

As describe above, the EGR valve 9 includes the control valves 9*a*, 9*a*, the rod 9*b*, the actuator 9*c*, the valve casing 9*f* or the like, and the EGR valve mechanism is formed by assembling them. The EGF gas flows from the left side to the right side in FIG. 4. The valve casing 9*f* between an inlet 9*d* for the EGR gas which is open on one side of the valve casing 9*f* in the EGR valve 9 and an outlet 9*e* for the EGR gas which is open on the other side thereof is provided therein with a bypass passage 24 which penetrates them, as well as the bypass passage 24 is provided therein with a restrictor 25, which is provided with an adjuster 26 for controlling a passage area in the restrictor 25. In other words, the bypass passage 24, which continuously connects the EGR pipe 14 and the intake manifold 3, is provided in the EGR valve 9.

Herein, as the high-temperature EGR gas passes through the bypass passage 24, it is preferable to select the position into which the bypass passage 24 is penetrated, so that the actuator 9*c* or the control valves 9*a*, 9*a* disposed in the EGR valve 9 is not directly subjected to the EGR gas.

As described above, the bypass passage 24 is provided in the mechanism making up the EGR valve 9, thereby eliminating the need for the particular thermal resistance specifications in the EGR cooler that has been conventionally provided on the upstream of the EGR valve, or the EGR valve itself, by replacing the EGR valve, even in the existing EGR device.

The adjuster 26 is provided with the restrictor 25 in the mechanism of the EGR valve 9, so that the EGR device 30 can have the general versatility of the engine specifications by controlling the opening degree of the restrictor 25. The EGR device 30 can be unified as the EGR unit, by providing the means for controlling the throttling degree in the mechanism making up the EGR valve 9.

INDUSTRIAL APPLICABILITY

The EGR device for the engine of the present invention is widely applicable in the EGR device for use in the engine, and in particular, it is applicable in the constructing technique for bypassing the EGR control valve provided with the EGR device.

The invention claimed is:

1. An EGR device for an engine comprising:

an EGR passage connecting an exhaust passage of the engine to an intake passage of the engine;

a control valve opened and closed for controlling an opening degree thereof defining a passage area of the EGR passage;

a valve casing attached to the engine, wherein apart of the EGR passage is formed in the valve casing, and wherein the control valve is provided in the valve casing so as to open and close the part of the EGR passage;

a detecting means for detecting an exhaust gas temperature of the engine;

a control means that controls the control valve in correspondence to the exhaust gas temperature detected by the detecting means so as to control the passage area of the EGR passage defined by the opening degree of the control valve;

a bypass passage bypassing the control valve;

a restrictor restricting a passage area of the bypass passage, wherein, when the exhaust gas temperature detected by the detecting means is not less than a predetermined value, the control means fully closes the control valve so as to recirculate exhaust gas from the exhaust passage to the intake passage via only the bypass passage having the passage area restricted by the restrictor.

2. The EGR device for the engine as set forth in claim 1, wherein the restrictor is configured so that the passage area of the bypass passage restricted by the restrictor is fixed.

3. The EGR device for the engine as set forth in claim 1, wherein the restrictor is configured so that the passage area of the bypass passage restricted by the restrictor is variable, and the restrictor is provided with an adjusting means for adjusting the passage area of the bypass passage.

4. The EGR device for the engine as set forth in claim 1, wherein the bypass passage is formed in the valve casing outside of the control valve so as to bypass the control valve.

5. The EGR device for the engine as set forth in claim 4, wherein the restrictor is disposed in the valve casing.

6. The EGR device for the engine as set forth in claim 5, wherein the restrictor is configured so that the passage area of the bypass passage restricted by the restrictor is variable, and wherein the valve casing is provided therein with an adjusting means for adjusting the passage area of the bypass passage.

* * * * *

UNITED STATES PATENT AND TRADEMARK OFFICE

CERTIFICATE OF CORRECTION

PATENT NO. : 8,146,573 B2
APPLICATION NO. : 12/521818
DATED : April 3, 2012
INVENTOR(S) : Hiroshi Oohashi It is certified that error appears in the above-identified patent and that said Letters Patent is hereby corrected as shown below:

In the Claims

In Column 8, line 24, claim 1, please delete “apart” and insert --a part--.

Signed and Sealed this
Sixth Day of August, 2013

Teresa Stanek Rea
*Acting Director of the United States Patent and Trademark Office*